US008251539B2

(12) United States Patent
Su

(10) Patent No.: US 8,251,539 B2
(45) Date of Patent: Aug. 28, 2012

(54) ENERGY SAVING LAMP

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 356 days.

(21) Appl. No.: 12/750,665

(22) Filed: Mar. 30, 2010

(65) Prior Publication Data

US 2011/0051422 A1 Mar. 3, 2011

(30) Foreign Application Priority Data

Aug. 31, 2009 (CN) ..... 2009 1 0306368

(51) Int. Cl.
*F21V 17/12* (2006.01)
*F21S 4/00* (2006.01)
*F21V 23/04* (2006.01)

(52) U.S. Cl. ... 362/232; 362/216; 362/222; 362/249.05; 362/249.12; 362/394

(58) Field of Classification Search ..... 362/216, 362/222, 225, 232, 235, 249.05, 249.12, 362/249.13, 394
See application file for complete search history.

(56) References Cited

U.S. PATENT DOCUMENTS

| | | | | |
|---|---|---|---|---|
| 5,523,931 | A * | 6/1996 | Kassay et al. | 362/235 |
| 5,624,179 | A * | 4/1997 | Korte | 362/222 |
| 6,414,801 | B1 * | 7/2002 | Roller | 362/240 |
| 6,626,557 | B1 * | 9/2003 | Taylor | 362/249.12 |
| 6,866,401 | B2 * | 3/2005 | Sommers et al. | 362/232 |
| 7,597,450 | B2 * | 10/2009 | Garrett | 362/216 |
| 7,862,200 | B2 * | 1/2011 | Custodis et al. | 362/249.02 |
| 8,087,802 | B1 * | 1/2012 | Hull | 362/216 |
| 2007/0195527 | A1 * | 8/2007 | Russell | 362/240 |

* cited by examiner

*Primary Examiner* — Alan Cariaso
(74) *Attorney, Agent, or Firm* — Altis Law Group, Inc.

(57) ABSTRACT

An energy saving lamp is provided. The energy saving lamp includes a main body, a circuit, an adjusting member, and a shielding device. The circuit includes a plurality of parallel loops, each parallel loop includes at least one light emitting member and a pair of open ends, the adjusting member is rotatably connected to the main body; the shielding device is fixed on the adjusting member; a conductive rod is fixed at the shielding device, and is received in an accommodating hole of the main body; when the adjusting member turns under a twisting force, it drives the shielding device to turn, the conductive rod moves in the accommodating hole to contact different number of the pairs of open ends to close the loops of the open ends, the light emitting members in the closed loops are thus turned on.

10 Claims, 5 Drawing Sheets

ENERGY SAVING LAMP

BACKGROUND

1. Technical Field

The disclosure relates to energy saving lamps and, particularly, to an energy saving lamp with adjustable brightness.

2. Description of Related Art

Nowadays, energy saving lamps, such as LED lamps, could not adjust brightness according to needs of users. So it could not be used in certain special situation. For example, for purpose of energy saving or decorating, the energy saving lamps may not need high brightness, conventional energy saving lamps without capability of adjusting brightness could not meet the needs.

BRIEF DESCRIPTION OF THE DRAWINGS

The components of the drawings are not necessarily drawn to scale, the emphasis instead being placed upon clearly illustrating the principles of the energy saving lamp. Moreover, in the drawings, like reference numerals designate corresponding parts throughout several views.

DETAILED DESCRIPTION

Figure 1:
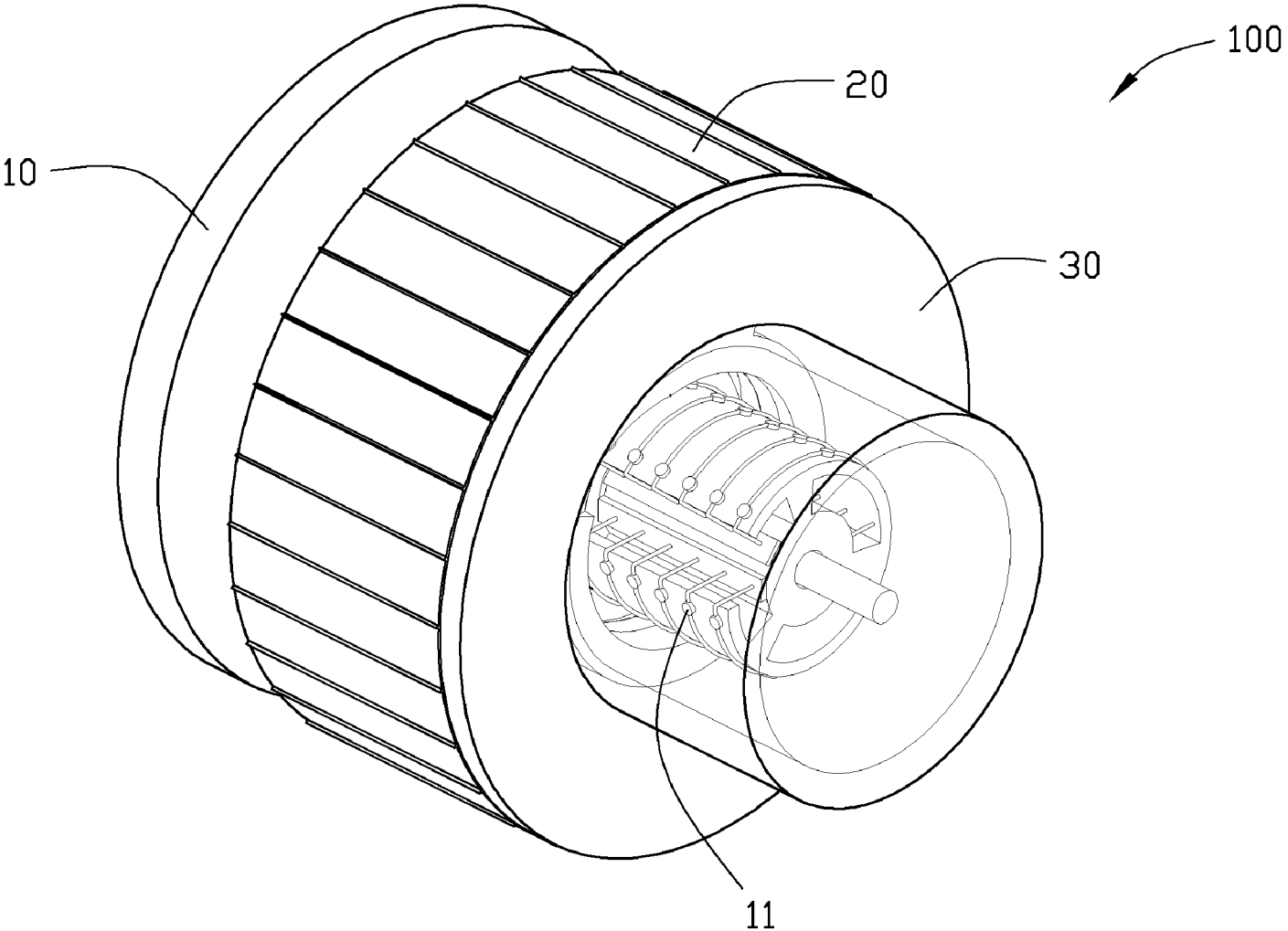
FIG. 1 is an isometric view of an energy saving lamp in accordance with an exemplary embodiment.

Referring to FIG. 1, an energy saving lamp 100 includes a main body 10, an illuminating device 11, an adjusting member 20, and a shielding device 30. The adjusting member 20 is rotatablely connected to the main body 10 and is configured for receiving an operation from a user to adjust brightness of the illuminating device 11.

Figure 2:
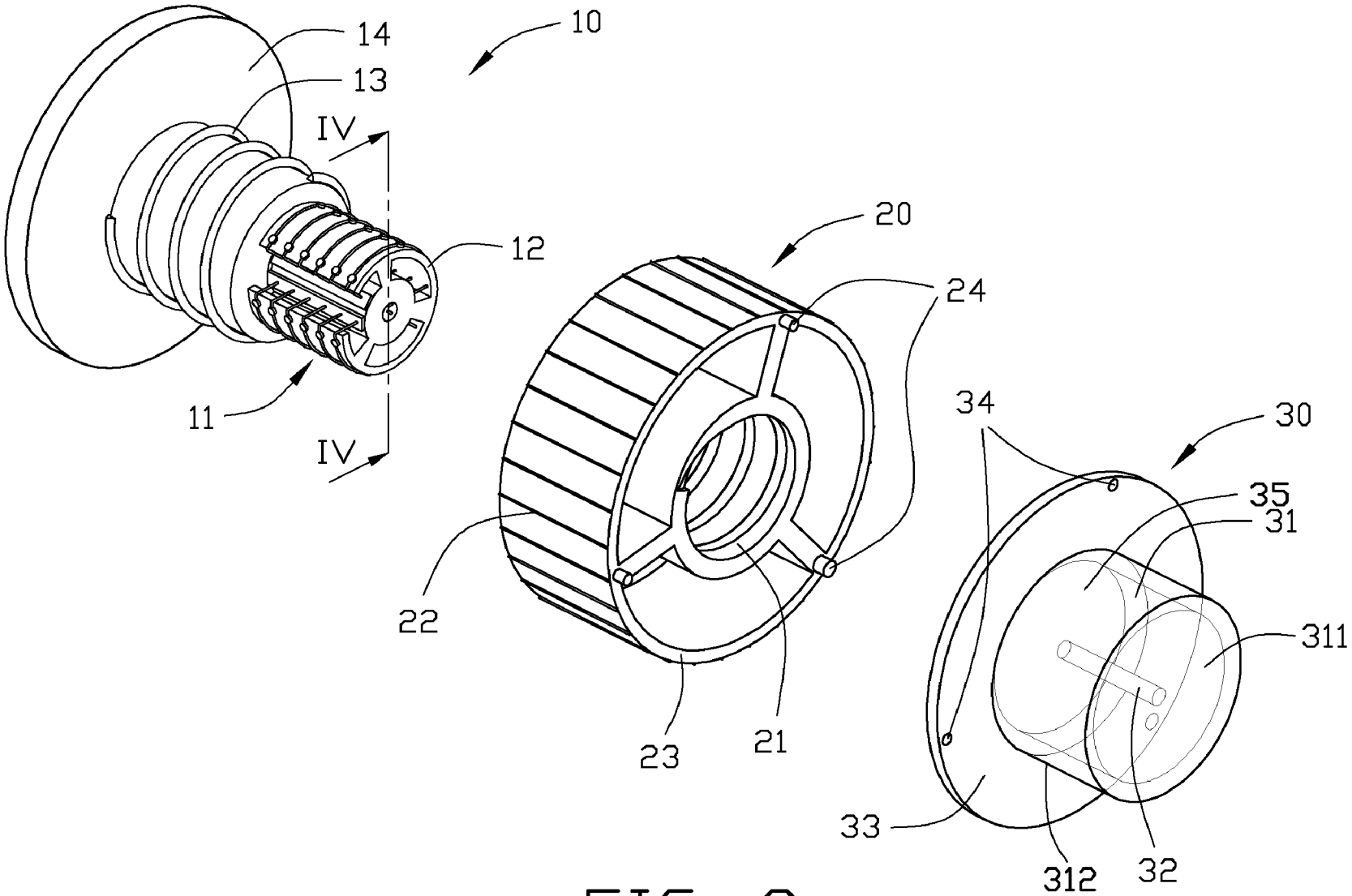
FIG. 2 is an exploded view of the energy saving lamp of FIG. 1.

Referring to FIG. 2, the main body 10 includes an end portion 12, a base 13, and a head 14. The end portion 12 is integrally formed with the base 13 and the head 14. The main body 10 is generally stepped-cylinder shaped, and made of electrically insulating material.

Figure 3:
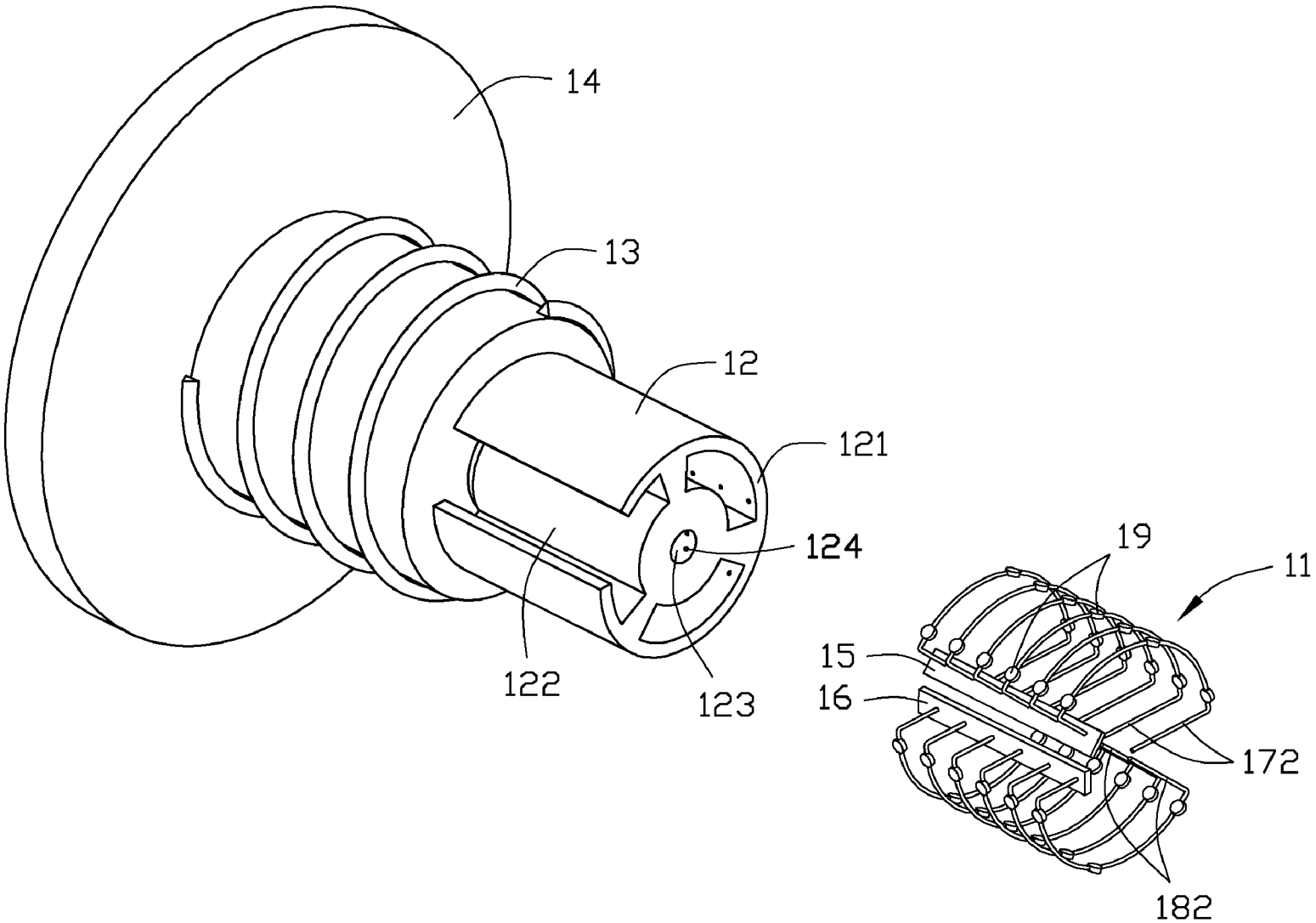
FIG. 3 is an exploded view of a main body of the energy saving lamp of FIG. 1.

Referring to FIG. 3, the end portion 12 defines a slot 122 and an accommodating hole 123. The slot 122 is formed in an outer surface of the end portion 12, and extends from an end surface 121 of the end portion 12. The accommodating hole 123 is formed along an axial direction of the end portion 12. The base 13 is a threaded pole. The diameter of the head 14 is greater than that of the end portion 12 and the base 13, and could be fixed on a wall or stand on a table.

The adjusting member 20 is cylinder-shaped, it defines a cavity 21 and forms a plurality of protrusions 24 along an periphery of an end 23. The cavity 21 is a threaded hole, and the base 13 is a threaded pole. The base 13 engages the cavity 21 to rotatablely connect the adjusting member 20. At least three protrusions 24 are formed on the end 23 of the adjusting member 20 and extend along the axial direction. Outer surface of the adjusting member 20 further includes a plurality of stripes 22 along the axial direction, thereby friction between the adjusting member 20 and the user's hand may be increased.

The shielding device 30 includes a hollow revolving body 31, a conductive rod 32, and a flange 33. The revolving body 31 includes a bottom portion 311 and a circumferential wall perpendicular to the bottom portion 311. The conductive rod 32 is fixed at central position of the bottom portion 311, and is movably received in the accommodating hole 123. In the exemplary embodiment, the conductive rod 32 is substantially cylindrical, and is made of metal. The flange 33 is formed around an opening 35 of the revolving body 31, and extends outwardly from lateral surface 312 of the revolving body 31.

The shielding device 30 may be fixed to the revolving body 31 by riveting. In the exemplary embodiment, a plurality of alignment holes 34 are formed in the flange 33. The protrusions 24 are received in the alignment holes 34, and then the shielding device 30 is fixed to the adjusting member 20. The number of the protrusions 24 and the alignment holes 34 are the same. The shielding device 30 is made of isolated high-transparency materials, which allows light from the illuminating device 11 to pass through.

Figure 4:
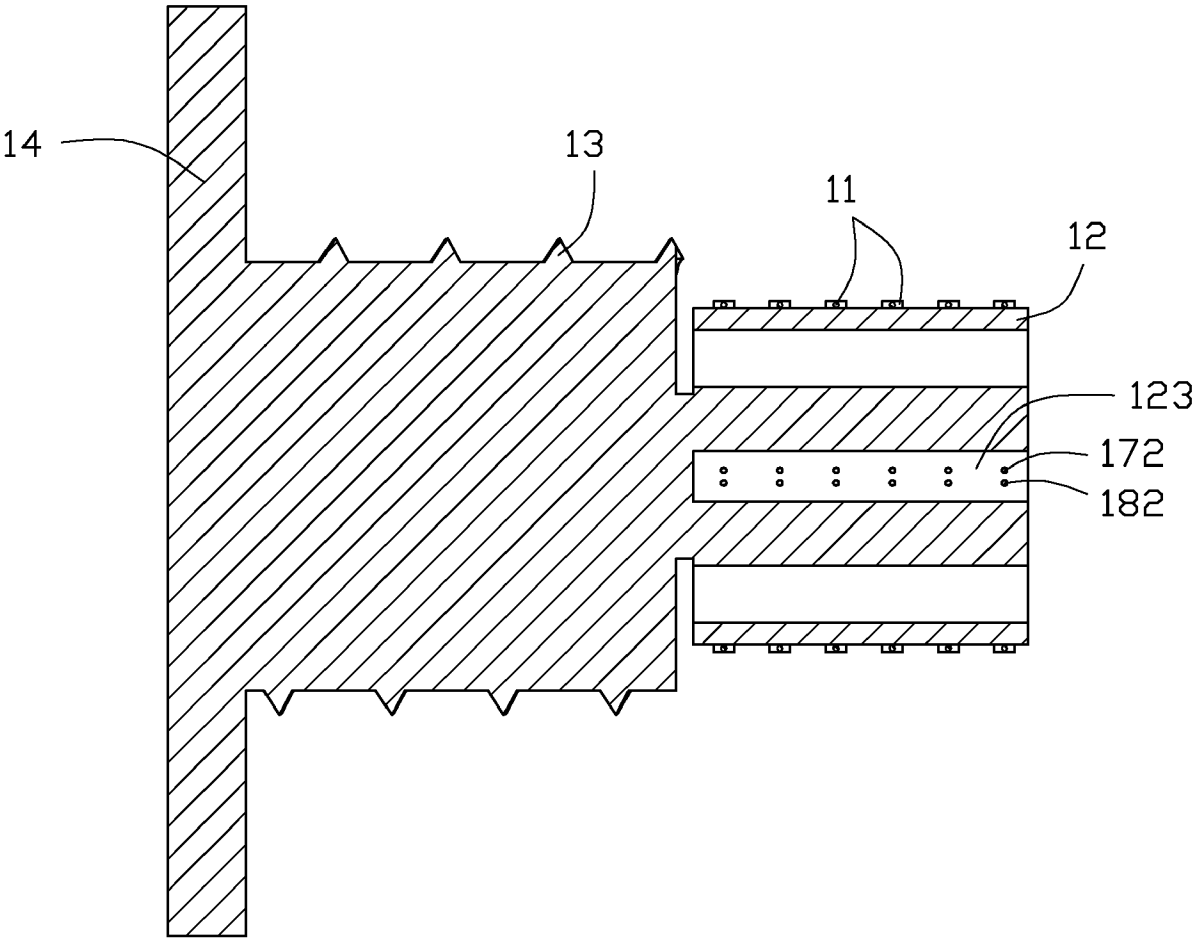
FIG. 4 is a schematic, cross-sectional view of the main body, taken alone line IV-IV of FIG. 2.
Figure 5:
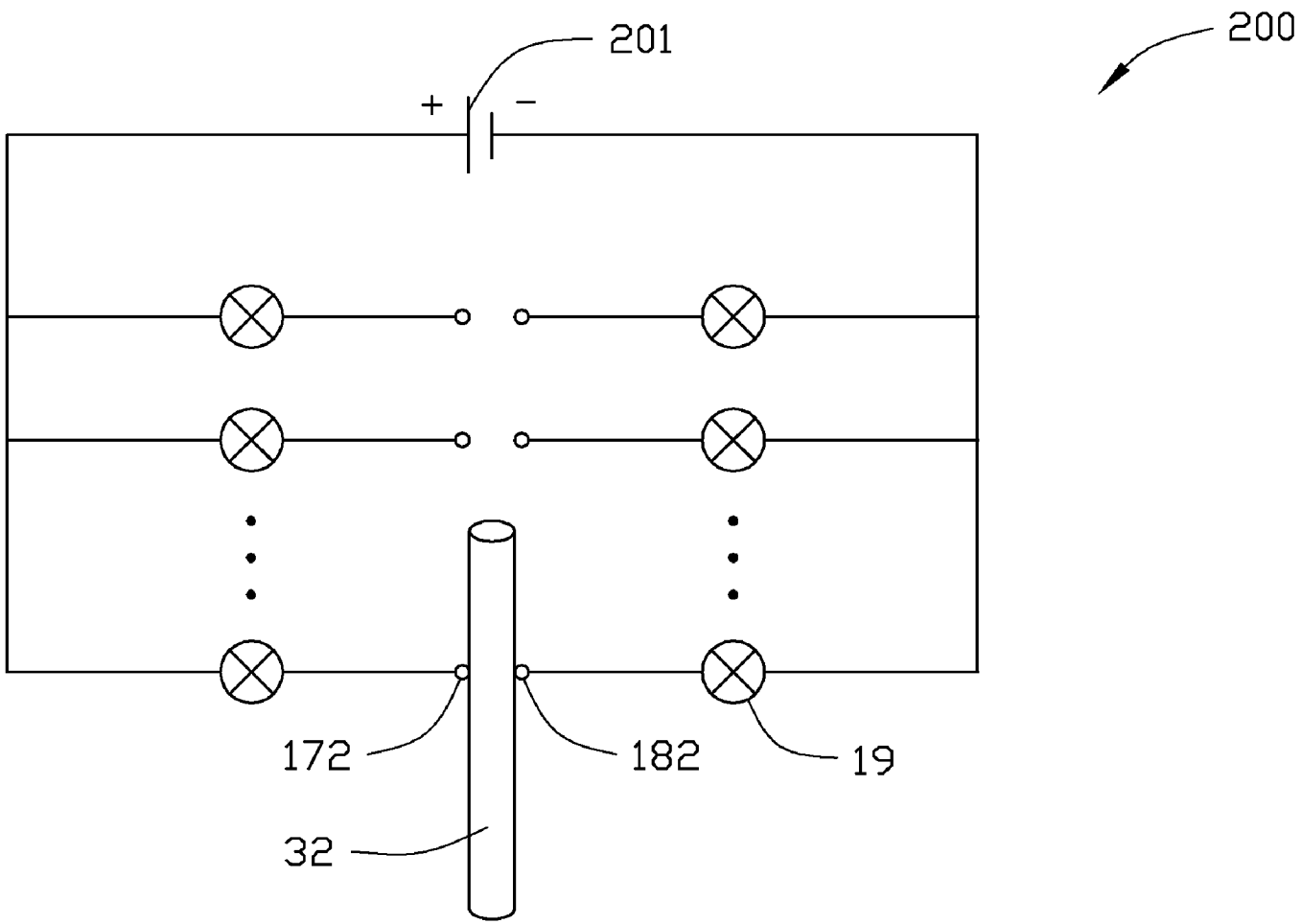
FIG. 5 is a circuit diagram of the energy saving lamp of FIG. 1, in accordance with an embodiment.

The illuminating device 11 is mounted on the end portion 12, and includes conductive plates 15, 16, a plurality of light emitting member 19, and a plurality of pairs of open ends 172, 182. The end portion 12 defines a plurality of through holes 124; the through holes 124 extend axially from the outer surface of the end portion 12 to inner surface of the accommodating hole 123. When being assembled, the conductive plates 15, 16 are fixed in the slot 122 of the end portion 12, and are electrically connected to two polarities of a power source 201 (as shown in FIG. 5) respectively. The plurality of pairs of open ends 172, 182 pass through the through holes 124 and are exposed in the accommodating hole 123 (as shown in FIG. 4).

When in use, the adjusting member 20 begins to turn along threads of the base 13 under the user's twisting force, and thus to drive the shielding device 30 to turn, the conductive rod 32 moves in the accommodating hole 123, and contacts the plurality of pairs of open ends 172, 182 in turn.

Referring to FIG. 5, a circuit 200 of the illuminating device 11 is provided. The circuit 200 includes a plurality of loops connected in parallel with a power source 201. Each of the loops includes at least one light emitting member 19 (e.g., LED), and a pair of open ends 172, 182. When the conductive rod 32 contacts the open ends 172 and 182, the loop is closed and the corresponding light emitting member 19 is illuminated, otherwise, each pair of open ends 172 and 182 are spaced from each other, and the loop is opened and the corresponding light emitting member 19 is powered off.

As described above, the movement of the conductive rod 32 in the accommodating hole 123 could contacts the plurality of pairs of the open ends 172, 182 and thus controls the plurality of loops' close, and finally controls illumination of the number of the illuminating light emitting members 19, thereby controlling brightness of the energy saving lamp 100.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An energy saving lamp comprising:

a main body defining an accommodating hole;

a circuit comprising a plurality of parallel loops, each parallel loop comprising at least one light emitting member and a pair of open ends, the pair of open ends being spaced from each other, and being exposing in the accommodating hole;

an adjusting member being rotatably connected to the main body;

a shielding device being fixed on the adjusting member;

a conductive rod being fixed at the shielding device, and being received in the accommodating hole of the main body;

when the adjusting member turns under a twisting force, it drives the shielding device to turn, the conductive rod moving in the accommodating hole to contact different number of the pairs of open ends to close the loops of the open ends, the at least one member in the closed loops are thus turned on.

2. The energy saving lamp as described in claim 1, wherein the circuit further comprises two conductive plates that are fixed in the main body, the two conductive plates are electrically connected to two polarities of a power source of the circuit respectively to power the loops.

3. The energy saving lamp as described in claim 2, wherein the main body is substantially stepped-cylinder shaped and further comprises an end portion, a base, and a head, the end portion is integrally formed with the base and the head, the accommodating hole is formed along an axial direction of the end portion.

4. The energy saving lamp as described in claim 3, wherein a slot is formed in an outer surface of the end portion, and extends from an end surface of the end portion, the conductive plates are fixed in the slot.

5. The energy saving lamp as described in claim 3, wherein the adjusting member defines a cavity, the cavity is a threaded hole, the base is a threaded pole, and the base engages the cavity to rotatablely connect the adjusting member.

6. The energy saving lamp as described in claim 1, wherein the shielding device comprises a hollow revolving body, the hollow revolving body comprises a bottom portion, and the conductive rod is fixed at the bottom portion of the hollow revolving body.

7. The energy saving lamp as described in claim 6, wherein a plurality of alignment holes are formed at the shielding device, the adjusting member forms a plurality of protrusions along an axial direction, the protrusions are received in the alignment holes to fix.

8. The energy saving lamp as described in claim 7, wherein the shielding device comprises a flange, the flange is formed around an opening of the revolving body, and extends outwardly from lateral surface of the revolving body, the alignment holes are formed in the flange.

9. The energy saving lamp as described in claim 1, wherein an outer surface of the adjusting member further comprises a plurality of stripes along an axial direction.

10. The energy saving lamp as described in claim 1, wherein the conductive rod is made of metal, the shielding device is made of isolated high-transparency materials.

* * * * *